US006217150B1

(12) United States Patent
Heydinger

(10) Patent No.: US 6,217,150 B1
(45) Date of Patent: Apr. 17, 2001

(54) METHOD OF PRINTING WITH AN INK JET PRINTER USING MULTIPLE CARRIAGE SPEEDS

(75) Inventor: Scott Michael Heydinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/330,586

(22) Filed: Jun. 11, 1999

(51) Int. Cl.[7] ..... B41J 2/21
(52) U.S. Cl. ..... 347/43
(58) Field of Search ..... 347/43, 20, 37, 347/41; 400/323, 323.1

(56) References Cited

U.S. PATENT DOCUMENTS 4,864,328 * 9/1989 Fischbeck ..... 347/43
5,900,891 * 5/1999 Shimoda ..... 347/43
5,929,876 * 7/1999 Bartolome ..... 347/20

* cited by examiner

*Primary Examiner*—N. Le
*Assistant Examiner*—K. Feggins
(74) *Attorney, Agent, or Firm*—Taylor & Aust, P.C.

(57) ABSTRACT

A method of printing on a print medium with an ink jet printer uses a plurality of different color inks including a first color ink. A movable carriage assembly carries at least one ink cartridge. The carriage assembly is movable at a first carriage speed and a second carriage speed across the print medium in a direction transverse to an advance direction of the print medium. An image area on the print medium has a plurality of rows of pixels, with the plurality of rows being adjacent to each other in an advance direction of the print medium and extending across the print medium in a transverse direction. The carriage assembly is moved across the print medium at the first carriage speed and the print medium is simultaneously printed on in at least one pixel within one of the rows of pixels using the first color ink. The carriage assembly is also moved across the print medium at the second carriage speed and the print medium is simultaneously printed on in at least one pixel within the one row of pixels using the first color ink.

13 Claims, 2 Drawing Sheets

METHOD OF PRINTING WITH AN INK JET PRINTER USING MULTIPLE CARRIAGE SPEEDS

BACKGROUND OF THE INVENTION

1. Field of the invention.

The present invention relates to ink jet printers, and, more particularly, to a method of printing using an ink jet printer.

2. Description of the related art.

Ink jet printers commonly include a printhead which is mounted on a carriage assembly. The carriage assembly is movable in a transverse direction, relative to an advance direction of a print medium such as paper. As the printhead is moved across the print medium during a particular pass of the carriage assembly, ink is selectively jetted from ink jetting orifices formed in the printhead and is deposited on the print medium at corresponding ink dot placement locations in the image area of the print medium. Since the printhead moves in a direction transverse-(e.g., perpendicular) to the advance direction of the print medium, each ink jetting orifice passes in a linear manner over the print medium. The line associated with each ink jetting orifice which overlies the print medium is commonly referred to as a raster or raster line. A plurality of rasters which extend across the image area of the print medium are disposed vertically adjacent to each other in the advance direction of the print medium.

Multi-color ink jet printers typically include a printhead having a plurality of ink jetting orifices therein. The ink jetting orifices are segregated into different arrays of ink jetting orifices, with each array corresponding to the different color inks which are to be jetted onto the print medium. With a known tri-color printhead, a first array of ink jetting orifices is used for jetting yellow ink onto the print medium, a second array of ink jetting orifices is used for jetting magenta ink onto the print medium, and a third array of ink jetting orifices is used for jetting cyan ink onto the print medium. The first, second and third arrays of ink jetting orifices are sequentially arranged relative to the advance direction of the print medium. Associated with each ink jetting orifice in the three arrays of ink jetting orifices is a corresponding ink jetting heater. Actuation of a particular ink jetting heater causes the formation of a bubble within the ink disposed adjacent thereto and expels the ink from the associated ink jetting orifice. A host computer connected with the printer transmits raster information to the printer for selective actuation of the ink jetting heaters.

To render a full color image, the tri-color printhead is passed across a print medium such as paper in a horizontal direction perpendicular to the vertical direction of alignment of the orifices in the printhead. Between passes of the printhead, the print medium is moved in the advance direction. For a raster, or row of printed dots, which contains at least one of each of cyan, magenta and yellow dots, the color printhead must be passed at least three times, once passing to deposit any cyan dots present in the given raster, once passing to deposit any magenta dots, and once passing to deposit any yellow dots. Of course, for any pass of the color head all 48 color orifices can be used, depositing the cyan, magenta, and yellow inks at different raster locations.

With known methods of printing with a tri-color printhead, a single carriage speed is selected prior to a print job and the carriage assembly is scanned during successive scans in opposite directions across the print medium at the same carriage speed. If a high quality print job is desired, the entire image is printed with a slower carriage speed.

Conversely, if a draft or lower quality print job is acceptable, the entire image within the image area is printed at the faster carriage speed.

What is needed in the art is a method of printing with an ink jet printer which allows both print quality and printer performance to be optimized, where appropriate, while printing an image within an image area.

SUMMARY OF THE INVENTION

The present invention provides a method of printing with an ink jet printer wherein a selected color ink is jetted onto a print medium at pixels in a row of pixels in two separate scans of the carriage assembly. During a first scan, the carriage assembly is moved across the print medium at a slower carriage speed providing high quality placement of the ink drops on the pixels. During a second scan, the carriage assembly is again moved across the print medium at the slower speed if a high quality print job is required, or a faster speed if a lower quality print job is acceptable.

The invention comprises, in one form thereof, a method of printing on a print medium with an ink jet printer using a plurality of different color inks including a first color ink. A movable carriage assembly carries at least one ink cartridge. The carriage assembly is movable at a first carriage speed and a second carriage speed across the print medium in a direction transverse to an advance direction of the print medium. An image area on the print medium has a plurality of rows of pixels, with the plurality of rows being adjacent to each other in an advance direction of the print medium and extending across the print medium in a transverse direction. The carriage assembly is moved across the print medium at the first carriage speed and the print medium is simultaneously printed on in at least one pixel within one of the rows of pixels using the first color ink. The carriage assembly is also moved across the print medium at the second carriage speed and the print medium is simultaneously printed on in at least one pixel within the one row of pixels using the first color ink.

An advantage of the present invention is that print quality is maximized in selected portions of an image area for a particular color ink, while printer speed is maximized in other selected portions of the image area for the same particular color ink.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

The exemplification set out herein illustrates one preferred embodiment of the invention, in one form, and such exemplification is not to be construed as limiting the scope of the invention in any manner.

DETAILED DESCRIPTION OF THE INVENTION

Figure 1:
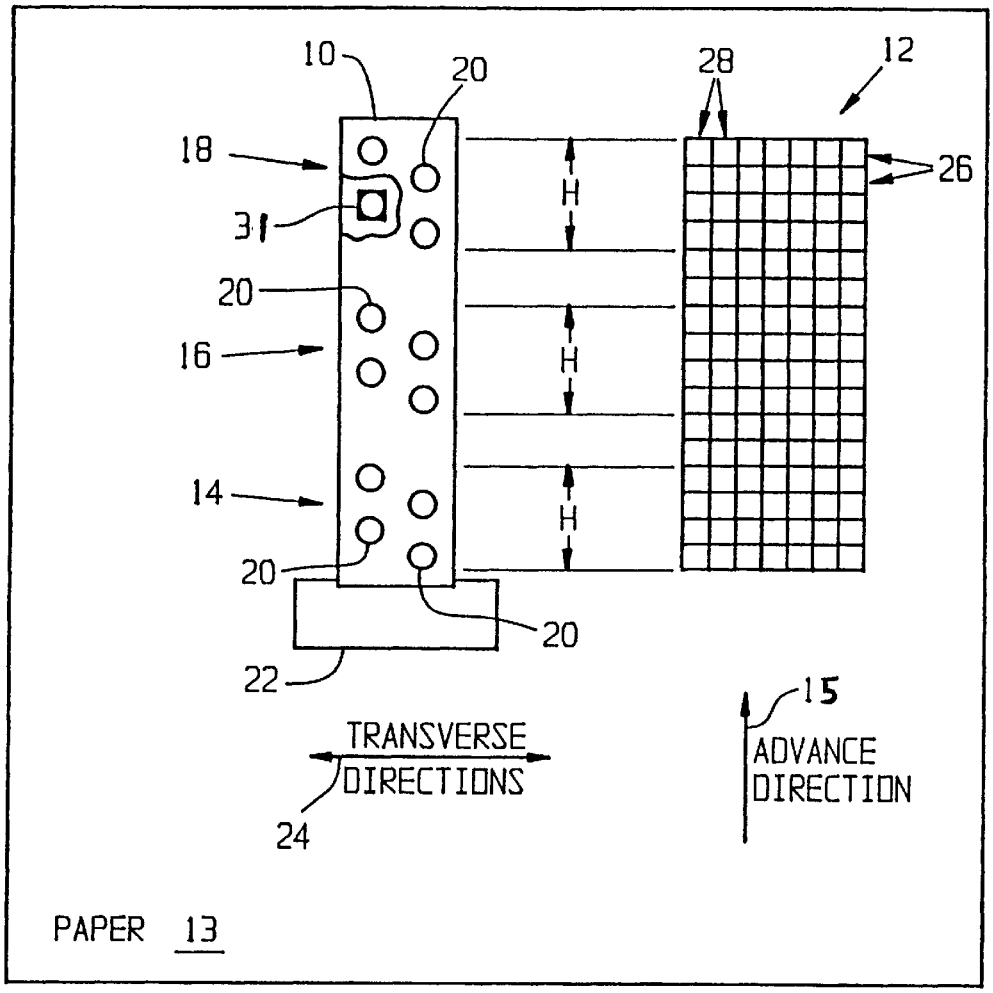
FIG. 1 a schematic view illustrating an embodiment of a printhead which may be used to carry out the method of the present invention, relative to a portion of an image area overlying a print medium.

Referring now to the drawings, and more particularly to FIG. 1, there is shown a schematic view of an embodiment of a printhead 10 of an ink jet printer 30 (FIG. 2) which may be used with the method of printing of the present invention, shown in relationship to a portion of an image area 12 overlying a print medium such as paper 13. Paper 13 is movable in an advance direction within the ink jet printer, as indicated by arrow 15. Printhead 10 includes three separate arrays 14, 16 and 18 of ink emitting orifices 20. In the embodiment shown, each array 14, 16 and 18 includes four ink emitting orifices 20 which are disposed in a staggered and vertically adjacent relationship relative to each other. That is, the bottom-most ink emitting orifice 20 in the right hand column of array 14 is disposed staggered and vertically adjacent relative to the bottom-most ink emitting orifice 20 in the left hand column of array 14. Each array 14, 16 and 18 of ink emitting orifices 20 has a common height H extending from an associated top-most ink emitting orifice 20 to a bottom-most ink emitting orifice 20. For manufacturing purposes, a gap corresponding to the height of two vertically adjacent ink emitting orifices 20 is provided between each of arrays 14, 16 and 18. Array 14 is used to jet cyan ink onto paper 13; array 16 is used to jet yellow ink onto paper 13; and array 18 is used to jet magenta ink onto paper 13. Thus, printhead 10 corresponds to a tri-color printhead used for carrying out multi-color printing. It will be appreciated that the number of ink emitting orifices 20 within each array 14, 16 and 18 may vary from that shown, and the physical position of the cyan, yellow and magenta arrays relative to each other may vary.

Printhead 10 is mounted to an ink cartridge (not shown) in known manner, which in turn is mounted to and carried by a carriage assembly 22, shown schematically in FIG. 1. Carriage assembly 22 is movable in directions transverse to advance direction 15, as indicated by double-headed arrow 24. Carriage assembly 22 and printhead 10 may be configured for single directional printing or bi-directional printing in known manner. Carriage assembly 22 is movable at a plurality of selectable speeds ranging between a minimum speed and a maximum speed.

Image area 12 overlying at least a portion of paper 13 is defined in part by the vertical spacing between ink emitting orifices 20. Image area 12 includes a plurality of rows of pixel locations 26 and a plurality of columns of pixel locations 28. Each pixel location within each row 26 of pixel locations has a height which corresponds to a center to center distance between vertically adjacent ink emitting orifices 20 on printhead 10. In the embodiment shown, the height of each pixel location within each row 26 has a height which corresponds to the height of an ink dot which is placed on paper 13 with an ink emitting orifice 20. However, it is also possible that the height of each pixel location within each row 26 may be greater than the actual height of an ink dot which is placed on paper 13 with an ink emitting orifice 20. Accordingly, for clarity and convenience sake, the height of each pixel location within each row 26 is defined as the center to center distance between vertically adjacent ink emitting orifices 20.

In the embodiment shown, each pixel location within each column 28 of pixel locations has a width which corresponds to the height dimension of each row 26. That is, each pixel location is substantially square. However, it is also to be understood that each pixel location may have a width which varies from the height, dependent upon the addressable resolution of the stepper motor in carriage assembly drive 40 (FIG. 2) which drives carriage assembly 22 carrying printhead 10.

Printhead 10 also includes a plurality of ink jetting heaters, one of which is shown and referenced 31 in FIG. 1, which are respectively associated with the plurality of ink emitting orifices 20. Each ink jetting heater 31 is actuatable at selected points in time during a scan of printhead 10 across paper 13 to jet the ink from an associated ink emitting orifice 20. Actuation of an ink jetting heater 31 at a selected point in time causes the rapid formation of a bubble at the base of an associated ink emitting orifice 20, thereby jetting the ink onto paper 13 in known manner.

With conventional methods of printing, a high quality or an economy mode of printing is selected prior to a print job and printhead 10 is moved across paper 13 in transverse directions 24 during successive scans at the corresponding carriage speed. The carriage speed of the movable carriage assembly remains constant for each successive scan across paper 13 during the print job. It is known to vary the distance which paper 13 is advanced between scans of the carriage assembly, and also to vary the exact placement of an ink dot within an associated pixel of an image area. However, conventional methods of printing use a constant carriage speed during the print job (corresponding to either a high quality print job or a lower quality print job), and maintain the carriage speed throughout the print job.

According to an aspect of the present invention, a determination is made as to whether it is necessary to place more than one ink dot at a pixel location within image area 12 using one of the three color inks jetted from arrays 14, 16 or 18. Carriage assembly 22 and printhead 10 are moved across image area 12 during a first scan at a slower carriage speed and an ink dot is placed at a desired pixel location on image area 12 using one of the three color inks. If a second ink drop of the same color is to be placed at the same pixel location, a determination is made as to whether the dot must be placed with high quality and placement precision, or whether a lower quality and placement precision will suffice. If a high quality and high placement precision are required, carriage assembly 22 and printhead 10 are again scanned across paper 13 at the slower carriage speed such that the ink dot may be placed at a desired location and "tails" from the ink dot are not formed. On the other hand, if it is determined that a lower quality and placement precision are acceptable, then carriage assembly 22 and printhead 10 are scanned across image area 12 of paper 13 at a faster carriage speed, thereby improving the printer throughput rate. The second scan to place the ink dots at desired pixel locations at the faster carriage speed can be carried out without advancing paper 13 in the advance direction between the first and second scans, but preferably is carried out by advancing paper 13 in advance direction 16 a distance such that another ink emitting orifice 20 within the corresponding array will overly the pixel location at which the additional ink dot is to be placed. The present invention therefore changes "on the fly" between a high quality print mode and a lower quality print mode for placement of multiple ink dots of a same color ink at a pixel location in an image area 12.

Figure 2:
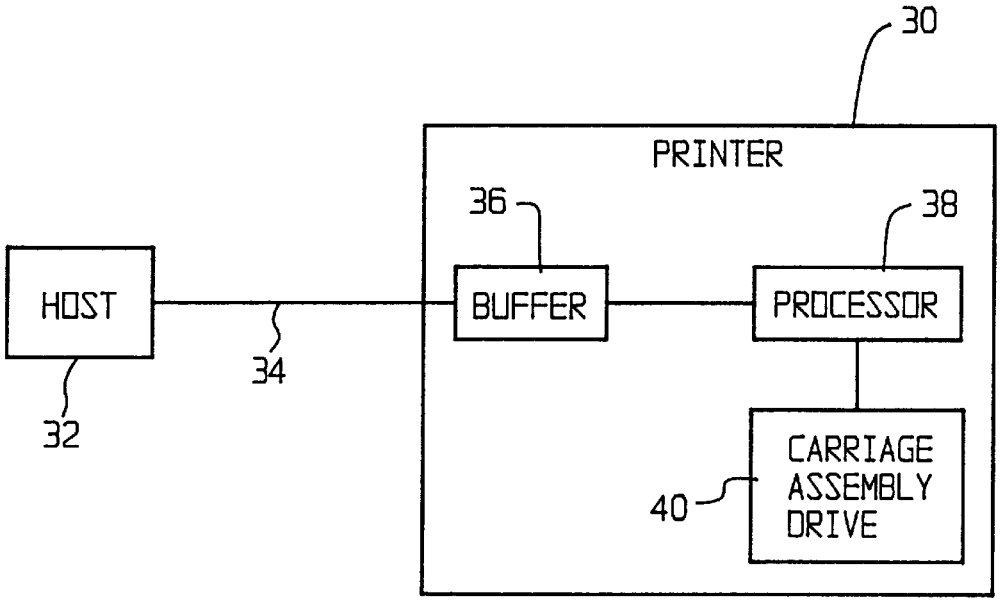
FIG. 2 is a simplified schematic view of a host computer connected with a printer used for carrying out the method of the present invention.

Referring now to FIG. 2, there is shown a schematic view of printer 30 coupled with a host computer 32, such as through an appropriate multi-conductor electrical cable. Host 32 includes application software operated by a user, and provides image data to printer 30 indicating an image to be printed. The image data provided by host 32 to printer 30 over conductor 34 may be provided in bit image format, wherein each bit corresponds to the placement of an ink dot of a particular color ink at a pixel location within a row 26 of pixel locations. The image data passes through a buffer 36 to a processor 38, such as a microprocessor. Processor 38 determines whether the second dot to be placed at a pixel location may be placed while the carriage assembly is traveling at a slower speed or a faster speed.

For example, if the image data received by processor 38 indicates that a dark shade is to be formed with a particular color ink on a plurality of pixels within image area 12, then placement of the second or additional ink dot of that particular color ink at a faster carriage speed is likely acceptable. Thus, processor 38 outputs a control signal to carriage assembly drive 40 causing carriage assembly 22 to scan across paper 13 during the second scan of carriage assembly 22 and printhead 10 at the faster carriage speed. On the other hand, if processor 38 determines that a light shade of the particular color ink is to be formed at a plurality of the pixel locations within image area 12, then processor 38 outputs a control signal to carriage assembly drive 40 causing carriage assembly 22 to travel at the slower carriage speed resulting in high quality and ink dot placement accuracy.

As another example, the addressable resolution of carriage assembly drive 40 may correspond to a resolution which is less than that of the image data provided from host 32 to printer 30 or the effective resolution of an ink dot placed at a particular pixel location within image area 12. More particularly, the size of any given ink dot which is jetted from an ink emitting orifice 20 may have a size (e.g., 600 dpi) which is smaller than the addressable resolution of carriage assembly drive 40 (e.g., 300 dpi). In such instances, it may be necessary to place more than one ink dot at a particular pixel location within image area 12 so that the printed image appears appropriately dark. If processor 38 determines that the second ink dot need not be placed with great accuracy and/or quality, then an appropriate control signal is sent from processor 38 to carriage assembly drive 40 which moves carriage assembly 22 at a faster carriage speed for placement of the second or additional ink dot at a particular pixel location within image area 12.

As a further example, in a process known as "shingling", image data at a particular resolution may be used to place ink dots within an image area during multiple successive passes of printhead 10. Generally, ink dots are placed within a checkerboard arrangement of possible ink dot locations during one pass of the printhead, and ink dots are placed within a complementary checkerboard pattern of possible ink dot placement locations during a successive pass of the printhead. Conventionally, the carriage assembly moves at the same carriage speed during successive passes of the printhead during the shingling printing technique. However, with the present invention, carriage assembly 22 may be moved at different carriage speeds during successive passes of printhead 10 across the image area. For details of known shingling printing techniques, reference is hereby made to U.S. patent application Ser. No. 08/592,822, entitled "METHOD OF INTERLACED PRINTING", filed Jan. 26, 1996, assigned to the assignee of the present invention, and to U.S. patent application Ser. No. 08/987,227, entitled "METHOD OF PRINTING WITH AN INK JET PRINTER USING INDEPENDENT SHINGLING ON A RASTER BY RASTER BASIS", filed Dec. 9, 1997, also assigned to the assignee of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of printing on a print medium with an ink jet printer using a plurality of different color inks including a first color ink, the print medium being movable in an advance direction, said method comprising the steps of:

providing a movable carriage assembly carrying at least one printhead, said carriage assembly being movable at a first carriage speed and a second carriage speed different from said first carriage speed across the print medium in a direction transverse to the advance direction;

defining an image area on the print medium having a plurality of rows of pixels, said plurality of rows being adjacent to each other in an advance direction of the print medium and extending across the print medium in a transverse direction;

moving said carriage assembly across the print medium at said first carriage speed and printing on the print medium on at least one pixel within one of said rows of pixels using the first color ink; and moving said carriage assembly across the print medium at said second carriage speed and printing on the print medium on at least one pixel within said one of said rows of pixels using the first color ink.

2. The method of printing of claim 1, wherein said second carriage speed is faster than said first carriage speed.

3. The method of printing of claim 2, wherein said first carriage speed is associated with a high quality print mode and said second carriage speed is associated with a lower quality print mode.

4. The method of printing of claim 1, wherein said carriage assembly is moved in a first transverse direction across the print medium during said first carriage speed moving and printing step, and wherein said carriage assembly is moved in a second transverse direction across the print medium during said second carriage speed moving and printing step, said second transverse direction being opposite to said first transverse direction.

5. The method of printing of claim 1, comprising the further steps of:

providing image data associated with said one of said rows of pixels; and determining whether said image data corresponds to at least one of a dark shade of the first color ink and a light shade of the first color ink; and wherein said second carriage speed moving and printing step is carried out dependent upon said determining step.

6. The method of printing of claim 5, wherein said second carriage speed moving and printing step is carried out if said image data corresponds to said dark shade of the first color ink.

7. The method of printing of claim 1, wherein each of said pixels in said image area have a first resolution, and wherein each of said first and second carriage speed moving and printing steps comprise printing on the print medium on said at least one pixel within said one of said rows of pixels with an ink dot resolution which is higher than said first resolution.

8. The method of printing of claim 1, wherein the first color ink comprises one of cyan ink, magenta ink, yellow ink and black ink.

9. The method of printing of claim 1, wherein said printhead has a plurality of ink jetting orifices associated with the first color ink, and wherein said first and second carriage speed moving and printing steps are carried out consecutively using at least one of said ink jetting orifices.

10. The method of printing of claim 1, wherein said first carriage speed moving and printing step comprises printing on the print medium on one said at least one pixel within said one of said rows of pixels using the first color ink, and wherein said second carriage speed moving and printing step comprises printing on the print medium on said one of said at least one pixels within said one of said rows of pixels using the first color ink.

11. The method of printing of claim 1, wherein said first carriage speed moving and printing step and said second carriage speed moving and printing step are carried out using a shingling printing technique.

12. A method of printing on a print medium with an ink jet printer using a plurality of different color inks including a first color ink, the print medium being movable in an advance direction, said method comprising the steps of:

providing a movable carriage assembly carrying at least one printhead, said carriage assembly being movable at a first carriage speed and a second carriage speed different from said first carriage speed across the print medium in a direction transverse to the advance direction;

defining an image area on the print medium having a plurality of rows of pixels, said plurality of rows being adjacent to each other in an advance direction of the print medium and extending across the print medium in a transverse direction;

moving said carriage assembly across the print medium at said first carriage speed and printing on the print medium on at least one pixel within said image area using the first color ink; and moving said carriage assembly across the print medium at said second carriage speed and printing on the print medium on at least one pixel within said image area using the first color ink.

13. A method of printing on a print medium with an ink jet printer using at least one ink including a first color ink, the print medium being movable in an advance direction, said method comprising the steps of:

providing a movable carriage assembly carrying at least one printhead, said carriage assembly being movable at a first carriage speed and a second carriage speed different from said first carriage speed across the print medium in a direction transverse to the advance direction;

defining an image area on the print medium having a plurality of rows of pixels, said plurality of rows being adjacent to each other in an advance direction of the print medium and extending across the print medium in a transverse direction;

moving said carriage assembly across the print medium at said first carriage speed and printing on the print medium on at least one pixel within said image area using the first color ink; and moving said carriage assembly across the print medium at said second carriage speed and printing on the print medium on at least one pixel within said image area using the first color ink.

* * * * *